United States Patent [19]

Cassou et al.

[11] Patent Number: 4,478,261

[45] Date of Patent: Oct. 23, 1984

[54] APPARATUS FOR FILLING ARTIFICIAL INSEMINATION STRAWS WITH SEMEN

[76] Inventors: Bertrand Cassou, Saint Symphorien les Bruyères; Robert Cassou; Maurice Cassou, both of Rue Clémenceau, 61300 L'Aigle, all of France

[21] Appl. No.: 349,357

[22] Filed: Feb. 16, 1982

[30] Foreign Application Priority Data

Feb. 20, 1981 [FR] France ..... 81 03353
Sep. 21, 1981 [FR] France ..... 81 17806

[51] Int. Cl.[3] ..... B65B 3/04

[52] U.S. Cl. ..... 141/2; 141/173; 141/283; 141/18

[58] Field of Search ..... 141/293-327, 141/129-191, 1-12, 18-29, 250-284

[56] References Cited

U.S. PATENT DOCUMENTS

| | | | |
|---|---|---|---|
| 3,391,518 | 7/1968 | Gettig et al. . | |
| 3,593,761 | 7/1971 | Lorenz | 141/155 |
| 3,877,204 | 4/1975 | Alter | 53/328 |
| 3,880,210 | 4/1975 | Randolph et al. | 141/175 |
| 3,935,885 | 2/1976 | Alter | 141/279 |
| 3,970,120 | 7/1976 | Whitecar | 141/1 R |

FOREIGN PATENT DOCUMENTS

| | | |
|---|---|---|
| 294585 | 11/1971 | Austria . |
| 1203503 | 10/1965 | Fed. Rep. of Germany . |
| 1002390 | 10/1951 | France . |
| 1401317 | 4/1965 | France . |
| 2010447 | 2/1970 | France . |
| 266769 | 2/1950 | Switzerland . |
| 486374 | 4/1970 | Switzerland . |
| 533542 | 3/1973 | Switzerland . |

OTHER PUBLICATIONS

Minitub Publication, an advertising borchure issued by the firm Simmet, Minitub GmbH, Hauptstr. 41, 8311 Tiefenbach B. Landshut, Western Germany, (published in 1972 or thereafter).

*Primary Examiner*—Houston S. Bell, Jr.
*Attorney, Agent, or Firm*—Merchant, Gould, Smith, Edell, Welter & Schmidt

[57] ABSTRACT

Small, compact and portable semen straw filling devices are hand operated by a single person.

A single turn of the handle advances a straw for filling and renders the straw removable by a handheld syringe with which an operator may guide the straw into an ovaduct of a turkey before squeezing the syringe and expelling the semen into the ovaduct. The device is portable so that it may be taken directly to the domestic birds and used by one man to impregnate a large number of birds in a short amount of time.

Using the present invention, a man simply cranks the filler, inserts the syringe, withdraws the syringe and straw, impregnates a bird, discards the straw and repeats the cycle. Turning a handle of one filler removes a straw from storage and aligns it with a nozzle while preloading a pump. Inserting the syringe triggers the pump, and withdrawing the syringe withdraws a loaded straw. Turning a handle on a second machine advances a straw from a hopper, inserts a nozzle in the straw while pushing a previously filled straw into a syringe, fills the straw and withdraws the nozzle. A person inserts the syringe, turns the handle and withdraws the syringe with a filled straw, impregnates a bird, discards the straw, reinserts the syringe and turns the handle to load the next straw in the syringe and to fill the following straw.

12 Claims, 14 Drawing Figures

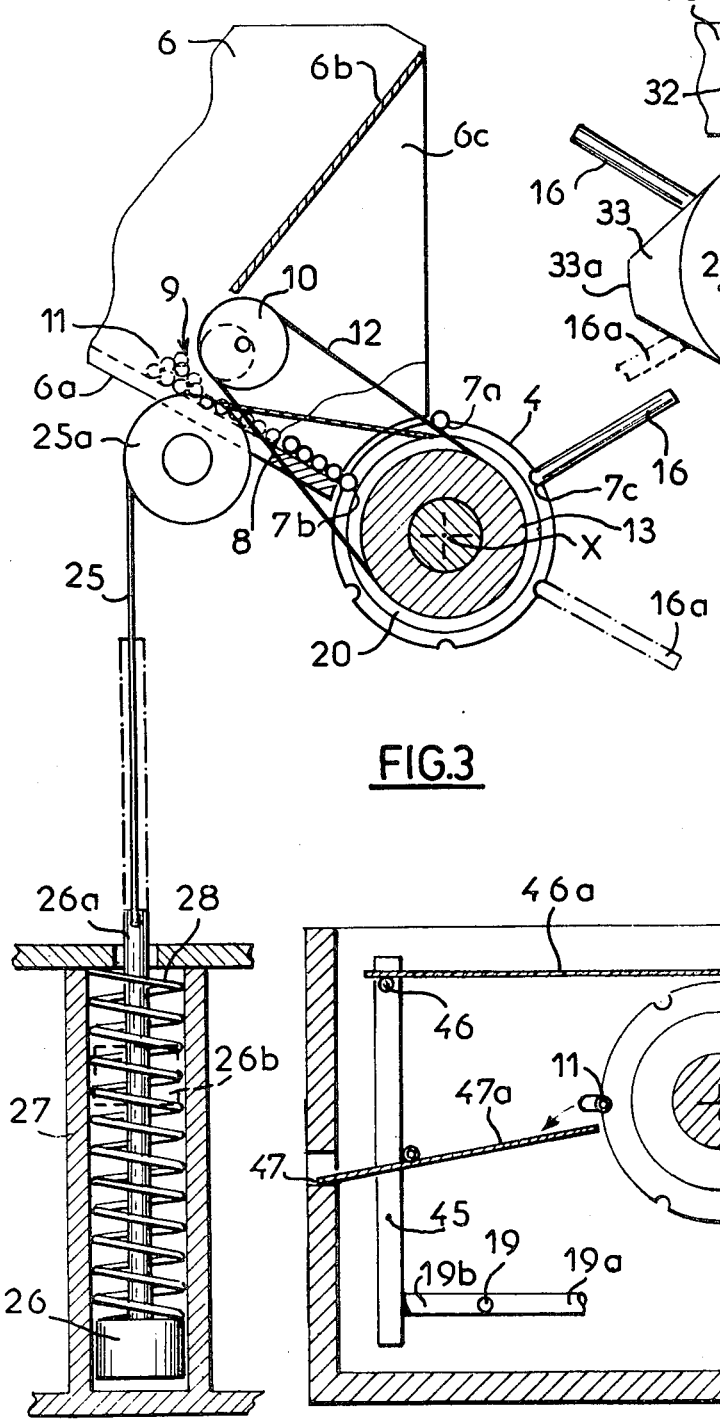
FIG.3
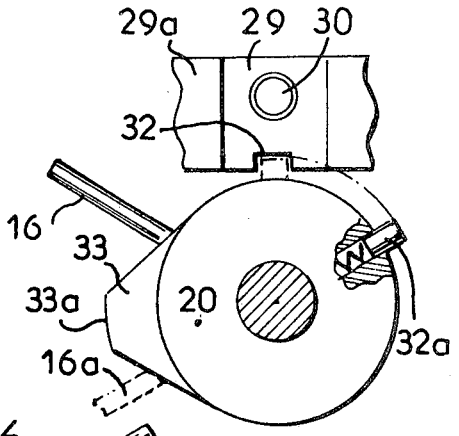
FIG.4
FIG.8

APPARATUS FOR FILLING ARTIFICIAL INSEMINATION STRAWS WITH SEMEN

The present invention relates to apparatus for filling straws with animal semen. The term straw refers to a tube which is used in artificial insemination, especially, but not exclusively, insemination of poultry, such as turkeys for example. The invention relates especially to apparatus which may be used for filling one-shot poultry straws, which are thrown away after use, to avoid contamination; such straws are dimensioned to contain a single dose of semen, sufficient to ensure effective insemination, for example a volume of 15 to 60 $mm^3$ according to the species, their internal diameter being sufficiently small to maintain the does of semen inside by capillary action alone, without any bung, which considerably simplifies handling when the straws are to be used for insemination immediately after filling without preliminary storage.

The invention provides apparatus which automatically and successively dispenses the straw one at a time and fills them with a very small dose, which is nonetheless precisely controlled, before their extraction, while presenting an overall size which is very small, so that the apparatus is portable.

Compared to manual filling, the apparatus provides considerable simplification, sanitary protection, savings both of semen, of which there is substantially no loss, and savings of time and manpower. Thus savings of cost are realized, and finally very fast operation enabling rapidly repeated inseminations, are of especial use in battery farming where there may be several thousands of birds (hens, guinea-fowl, geese, ducks and especially turkeys).

The invention provides an apparatus for filling straws with semen comprising a support member presenting at least one slot for receiving a straw, dispensing means for dispensing straws one at a time from a stock into said slot at a dispensing station, displacement means for displacing said support member so as to bring the straw in said slot to a filling station, and a nozzle adjacent said filling station for injecting semen into the straw, characterised in that said nozzle is mounted for movement longitudinally of said slot at said filling station in engagement with said straw, the apparatus including a tube for feeding semen from a supply to said nozzle, pump means for displacing a controlled quantity of semen in said tube so as to expel a corresponding quantity of semen from said nozzle, and actuating means for actuating said pump means after said movement of said nozzle, whereby said semen is expelled from the nozzle into the straw.

This apparatus enables the straws to be fed into the slot, then brought into engagement with the nozzle which ejects a dose of semen into the straw. The straw may subsequently be extracted directly in a holder. These simple operations enable the semen to pass directly from the supply to the straw through the connecting tube only, so that the semen goes through no mechanism likely to deteriorate it by throttling, emulsion, oxidation or otherwise.

In one preferred embodiment, the support member comprises a drum rotating about a horizontal axis and presenting a plurality of said slots spaced equally around the drum, said displacement means comprising means for rotating said drum to bring said slots successively to said dispensing station to said filling station.

The pump means preferably comprises compressing means movable between a compression position in which said tube is compressed and a decompression position in which said tube is rotatively decompressed. This arrangement is of especial help in avoiding contact between the dose of semen to be pumped and any mechanism, since it acts on the outside of the tube.

In one embodiment, said actuating means comprises energy storage means and drive means for driving said displacement means and storing energy in said energy storage means, said actuating means being responsive to subsequent movement of said nozzle to release the energy in said energy storage means to actuate said pump means. The apparatus may include a holder adapted to engage and hold one end of the straw at said filling station and displacing the straw in said slot so that the opposite end of the straw engages and moves said nozzle, said holder comprising means for ejecting semen from said opposite end of the straw during insemination. The straw can then be extracted in the holder manually from the apparatus and immediately used for insemination, without the semen contracting any further mechanism and without direct handling, being introduced directly into the cloaca, which is important for hygiene. Said energy storage means may include damping means to slow the release of energy and the expulsion of semen, to avoid formation of bubbles in the semen ejected into the straw, which are undesirable for insemination.

The apparatus is preferably actuated manually, by loading it by a reciprocating lever, or by cranking a handle for example, so that it is relatively autonomous and can be actuated by the operator without requiring any external or internal source of energy, such as electricity or compressed air, which helps the portability of the machine and facilitates its mobile use in the middle of the poultry pens or batteries. However, it is also possible to incorporate a source of energy and a mechanical motor, but with a weight and size penalty, of course.

In a preferred embodiment, said pump means includes inlet and outlet stops for respectively compressing said tube at the inlet and outlet to said compression means, whereby to prevent flow of semen in said inlet and outlet respectively, said compression means being arranged to compress said tube in said compression position over a length corresponding to the volume of semen to be expelled, said actuating means being arranged to actuate said inlet stop, said compression means and said outlet stop in cyclic succession, whereby to pump semen. Preferably said compression means extends over substantially the whole length of said tube between said stops. The compression means may include regulating means for regulating the quantity of semen ejected.

In another embodiment the apparatus includes drive means for successively driving said displacement means to transport the straw to said filling station, displacing the nozzle from an initial position to engage said straw, operating said actuating means whereby to fill the straw, and returning the nozzle to said initial position. In this way no manipulation is necessary to engage the straw and the nozzle together for filling, and the same operation brings the straw to the filling station and fills it, whereas in the first embodiment, two separate manipulations were necessary (loading and presenting the holder to push the straw against the nozzle). This second embodiment is more readily adapted to automatic operation (by an internal energy source).

Advantageously said support member comprises a rotary drum bearing a plurality of said slots spaced equally around the drum, said displacement means comprising a rotary shaft, and said drive means including linear reciprocating means connected drivingly with said shaft for displacing the nozzle. Conveniently said displacement means comprises friction means connected drivingly between said shaft and said drum, indexing means for immobilising said drum, in positions in which two said slots are aligned with said dispensing station, and with said filling station and disabling means for disabling said indexing means after actuation of said reciprocating means. In this way the drive shaft drives the drum during the initial movement through a step which brings the straw to the filling station and then, during all the rest of the movement, drives the nozzle and pump.

It may then be provided that said displacement means is arranged to move said support member to bring a filled straw from said filling station to a further station, the apparatus including a plunger mounted adjacent said further station for movement with said nozzle to engage one end of the filled straw at said third station and displace the straw in the slot so as to engage a straw holder presented to the other end of the filled straw. The filled straw is thus fitted into a holder by the plunger, in the same movement as the engagement of the empty straw by the nozzle, and can then be directly used for insemination.

Other features and advantages of the invention will appear from the following description given by way of non-limitative example with reference to the accompanying drawings, in which:

FIG. 3 is a left side sectional view of the apparatus on the line 3—3 of FIG. 2.

FIG. 4 is a right side sectional view taken on the line 4—4 of FIG. 2.

FIG. 8 is a right side sectional view of the apparatus, perpendicular to the drum axes showing a further support and outlet mechanism;

Figure 1:
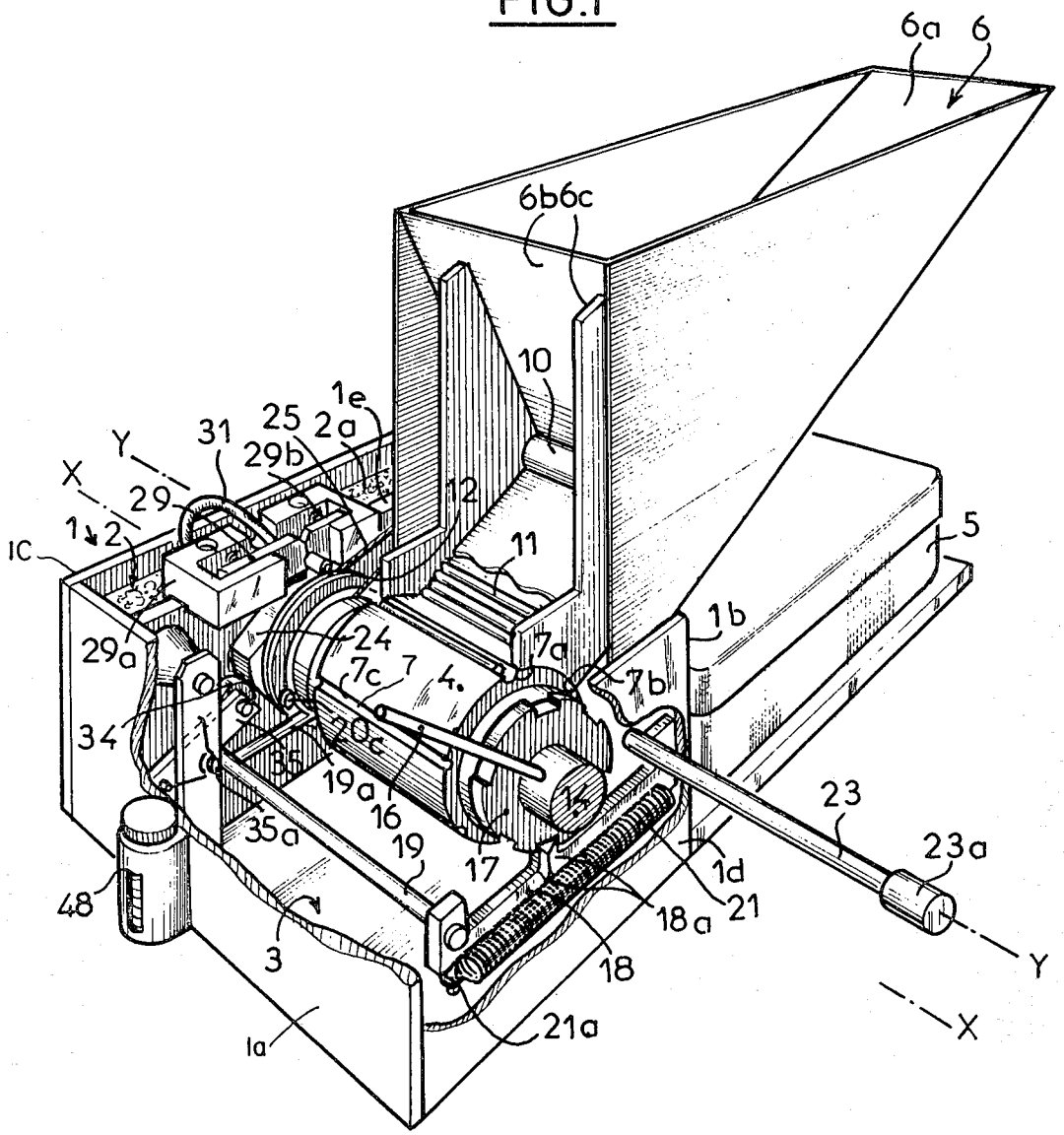
FIG. 1 is a perspective view partly cut away of an apparatus which is a first embodiment of the invention.

The apparatus shown in FIGS. 1 to 8 is basically disposed within a parallelepiped case 1 comprising a front wall 1*a*, a rear wall 1*b*, and two side walls 1*c* and 1*d*, a further internal vertical wall 1*e* being disposed close to the wall 1*c*, so as to define therewith a storage compartment 2, while the remainder of the housing forms a main compartment 3. In the main compartment a drum 4 is mounted for rotation about a horizontal axis X—X parallel to the front wall 1*a*. Outside the housing 1 is disposed a store of straw packs 5 behind the wall 1*b* and a hopper 6 for dispensing straws, disposed above the store 5 and the rear of the housing 1. The drum 4 comprises peripheral slots 7 for receiving the straws comprising longitudinal grooves of semi-cylindrical section, extending parallel to the axis X—X and spaced regularly round the circumference of the drum, there being for example six slots spaced at 60°.

In the rest position shown in the drawings one of the slots 7*a* is positioned at the upper generatrix of the drum and, as shown in FIG. 3, the hopper 6 presents a lower part which covers the cylindrical sector defined by this upper slot 7*a* and the slot 7*b* which precedes it directly on the side towards the rear wall 1*b*. Facing the slot 7*b* is disposed the lower edge of an inclined plane 8 which constitutes the extension of one of the walls 6*a* of the hopper 6, inclined towards the rear of the apparatus and which, with another wall inclined towards the front defines a passage for introducing and dispensing the straws one by one onto the inclined plane 8. This passage 9 is defined by the wall 6*a* and a cylinder 10 whose axis is parallel to the axis X—X, disposed at the base of the wall 6*b* and mounted eccentrically so that in one of its extreme positions it opens the passage 9 to a width corresponding substantially to the diameter of a straw, while in the other extreme position, it closes the passage 9 to a reduced width and prevents any straws passing. It follows from this arrangement that the straws 11 which are disposed in the hopper 6 parallel to the axis X—X on the bottom 6*a* are allowed to pass only one at a time under the cylinder 10, and the straws then appear in a flat row on the inclined plane 8, to be introduced successively into the slots of the drum 4 which arrive in succession at the position 7*b*. The cylinder 10 is driven stepwise in a rotary motion always in the same direction, by a belt 12 which passes round the cylinder in a reduced diameter groove 13 disposed at the left side of the drum 4. The straws are maintained on the inclined plane 8 in parallel relation with the slot 7*b* by means of two lateral vertical guide walls 6*c* disposed beneath the bottom 6*b* of the hopper 6 and matching the shape of the sector of the drum disposed between the slots 7*a* and 7*b*.

Figure 2:
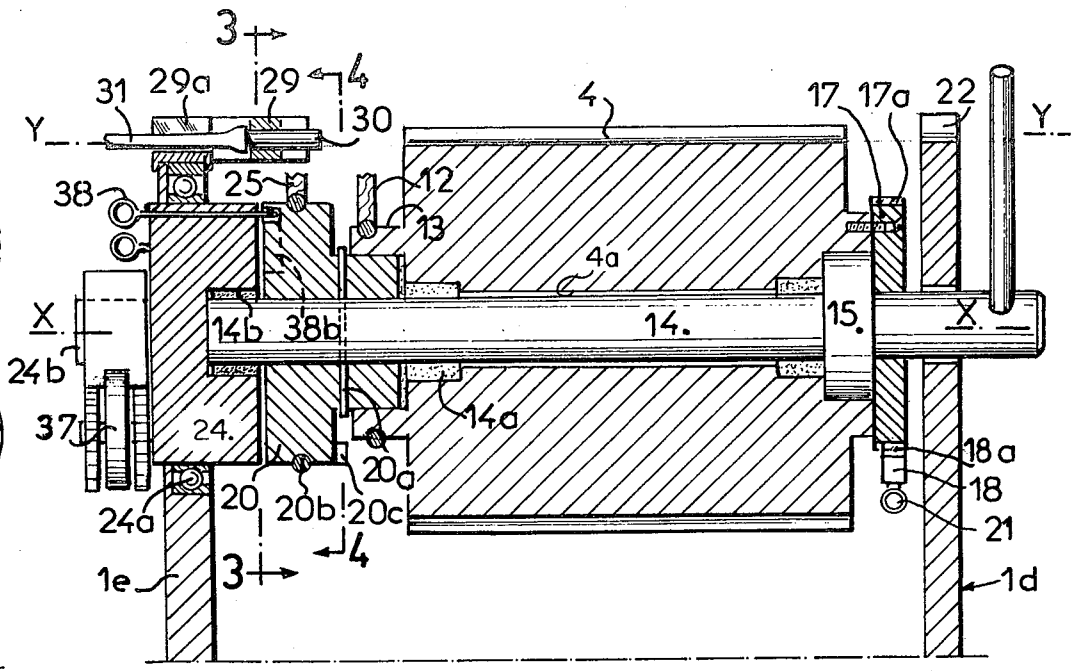
FIG. 2 is a vertical sectional view along the drum axis of this machine.

As shown in FIG. 2, the drum 4 presents a central bore 4*a* through which passes a rotary drive shaft 14 on which the drum is mounted by means of, at one end a guide ring 14*a* allowing free rotation, and at the other end a free-wheel 15 mounted so as to enable the drum to be driven by the shaft 14 only in the direction which displaces the slots in the drum from the position 7*b* towards the position 7*a*, that is to say towards the front of the housing 1 and away from the hopper 6. Adjacent the free-wheel 15, disposed beside the wall 1*d* of the housing 1, the shaft 14 extends through the wall 1*d* and bears at its end an operating lever 16 extending radially and which, in the rest position shown in FIGS. 1 and 2, is positioned in the plane containing the slot 7*c* after the slot 7*a* (towards the front wall) and at 60° to the vertical.

Between the end face of the drum 4 bearing the free-wheel 15 and the wall 1*d* of the housing is disposed a notched wheel 17 which is solid with this end face of the drum and presents a reduced diameter, so as to leave free longitudinal access to the slot 7*a*, this notched wheel 17 bearing on its circumference rectangular notches 17*a*, of the same member and spacing as the slots 7 of the drum 4. In the bottom-most notch of the wheel 17 engage two vertical fingers 18*a* projecting from the ends of two horizontal levers 18 which extend perpendicular to the axis X—X respectively for and rearwardly, and are pivoted at their other ends about axes parallel to the axis X—X. The fingers 18*a*, present end surfaces which project to the bottom of the notch 17*a* and form bezels which converge towards each other away from the bottom of the notch, while the outer faces of the fingers engage flat against the sides of the notch.

The rearmost lever 18 is mounted for free rotation about its pivot, whereas the foremost lever is solid with a transverse control bar 19 parallel to the axis X—X and which extends over the whole length of the drum 4, the other end of the bar bearing a radial rod 19*a*, which extends generally horizontally and bears underneath the circumference of a rotary plate 20 which is mounted on the drive shaft 14 beyond the groove 13 of the drum 4 and is fixed relative to the shaft by a key 20*a*. The lever mechanism 18 is completed by a return spring 21 fixed to two logs 21*a* projecting downwards from the levers 18 adjacent their pivots.

It follows that the end of the shaft 14 bearing the lever 16 is freely journalled in the housing wall 1*d*, which also comprises, on its upper edge, a circullar recess 22 aligned with the slot 7*a* of the drum in the longitudinal axis Y—Y of the slot 7*a*, and having a greater diameter than the slot. In fact, the slots such as 7*a* of the drum 4 are designed to receive very thin diameter straws 11, while the recess 22 is designed to provide a support for the end of a holder pipe 23, comprising a stationary cylindrical tube whose inner diameter enables the pipe to be fitted on the end of the straw 11. This stationary pipe can be grasped and manipulated by the operator and at its end opposite to that which engages the recess 22, has a bulb 23*a* for blowing air.

At the other end, the drive shaft 14, which is solid with the plate 20, is journalled freely in a second rotary plate 24, of the same diameter as the plate 20, which itself is mounted for free rotation in a ball-bearing 24*a* fitted in the housing wall 1*e*, the end of the shaft 14 engaging in a ring 14*b* fitted in a blind bore in the plate 24.

The plate 20, solid with the shaft 14, has a peripheral groove 20*b* and an anchor point to which is fixed a cable 25 which passes round a pulley wheel 25*a* as seen in FIG. 3, to be connected at its other end to the rod 26*a* of a piston 26 sliding, with a dashpot clearance, in a cylinder 27 formed in the housing behind the plate 20. Between the piston and the top of the cylinder, adjacent the cable 25, is disposed a compression spring 28 which is entended when the piston 26 is at the bottom of the cylinder, corresponding to the position of the drum 4 as shown in FIGS. 1, 2 and 3 in which the operating lever is in its upper position. However, the spring 28 is compressed when the piston 26 is displaced by the cable to the position 26*b* on rotation of the drum 4 through 60° by displacement of the lever 16 to the lower position shown in chain-dotted lines in FIG. 3. The plate 20 referred to also comprises, on its face juxtaposed to the drum 4, a peg 20*c* projecting towards the drum 4 so as to be disposed in the same plane as the control rod 19'*a* mentioned previously. In the rest position shown in FIGS. 1, 2 and 3, the position of the peg is not at the bottom of the plate 20, but is spaced angularly from the bottom by a few degrees, so as not to contact the rod 19*a*.

Above the plate 20, is disposed a movable nozzle support comprising a slider 29 through the middle of which passes a nozzle or tip 30 which extends horizontally in the axis Y—Y towards the uppermost slot 7*a* of the drum 4, but spaced from the adjacent end of the slot, while its other end is connected to a flexible feed tube 31. The slider 29 is mounted for translatory movement in the direction Y—Y between parallel faces of a guide block 29*a* which is fixed to the partition wall 1*e* to the rest position shown in the drawings, the slider abuts against the faces of the block adjacent the slot 7*a* so as to present the nozzle 30 at its closest to the slot. Compression springs act between the back face of the slider and the back of the block 29*a*. In the position shown, the slider 29 is disposed precisely above the plate 20 and as shown in FIG. 4, comprises on its bottom surface a recess 32 in direct facing relation to the circumference of the drum 4. On this circumference, the drum 20 bears a radially projecting lug 32*a*, biased outwardly by a spring, and in the rest position shown in the drawings, the lug 32*a* is spaced by an angle of 60° from the vertical and is thus aligned with the slot 7*b* on the drum. The dimension of the lug is such that, when the drum 20 is rotated through 60°, the lug can engage, after temporary compression of the bias spring, into the recess 32 in the slider 29 as shown in chain-dotted lines in FIG. 4.

Lastly, the drum 20 is completed by a cam 33 projecting radially from its circumference, the cam extending over an effective angle of about 90°, with its central part presenting a maximum lift with a contour substantially cylindrical over about 20° and connecting with the drum surface by two ramp parts. The cylindrical part 33*a* of the cam projects substantially horizontally towards the front of the housing when the apparatus is in the rest position shown in the drawings, and especially in FIG. 4. The cam cooperates with a roller 34 borne by the end of one of the arms of a two-armed lever 35 which rocks on an axis 35*a* parallel to the axis X—X and disposed on a fixed frame of the housing. In the rest position shown, the lever arm bearing the roller 34 is positioned so that the roller 34 rests on the circumference of the drum 20, beneath the cam 33.

Figure 5:
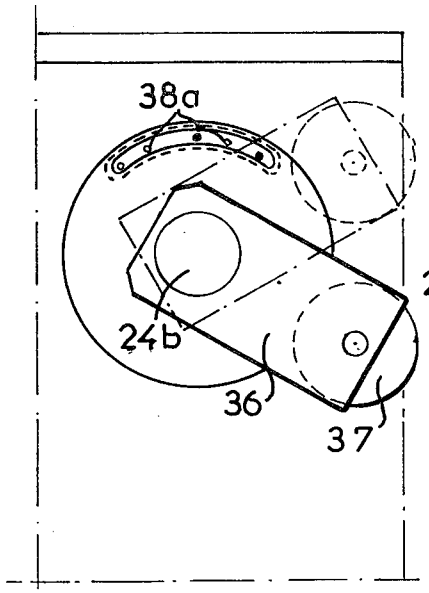
FIG. 5 is a left side outer view of the apparatus as shown in FIG. 2.

As shown in FIGS. 2 and 5, the face of the plate 24 projecting into the compartment 2 bears a stub axle 24*b* which is solid with a radial lever 36, which bears at its free end a roller 37 mounted for free rotation. In the rest position shown, the arm 36 carrying the roller extends at 30° downwards from the horizontal.

As shown in FIG. 2, the two plates 20 and 24 can be connected in rotation by two pins 38 which pass axially through the plate 24, being disposed in two holes chosen out of a set of holes 38*a* in the plate 24 their ends projecting into a part circular groove 38*b* in the face juxtaposed with the plate 24.

Figure 7:
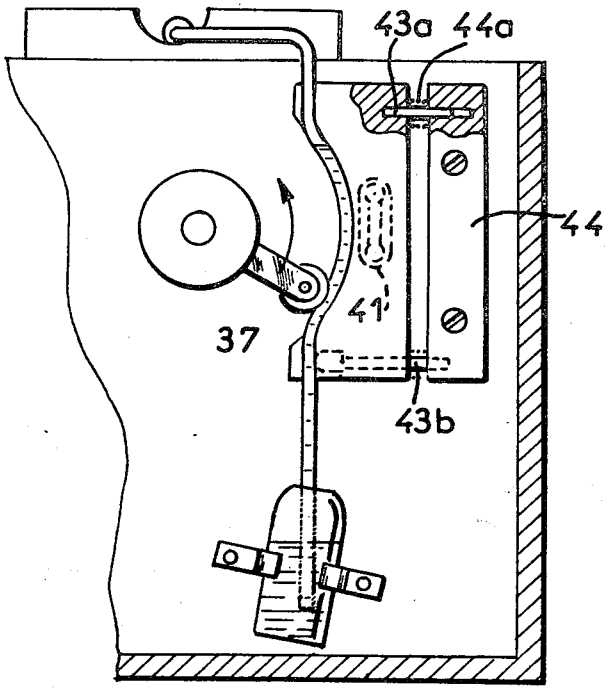
FIGS. 6 and 7 are similar views to FIG. 5, but more complete, showing the operation of the displacement member in two extreme positions of travel.
Figure 6:
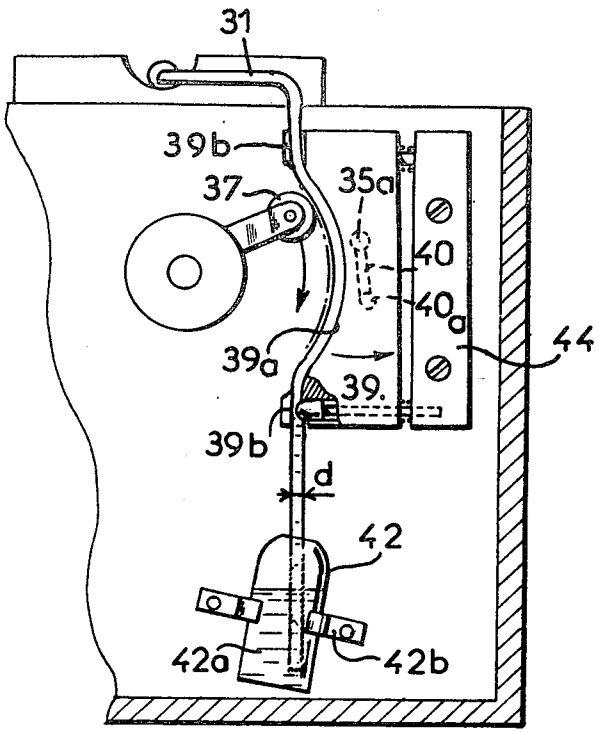

As shown in FIGS. 6 and 7, the roller 37 cooperates with a counter block 39. The block 39 comprises a thick plate paralled to the wall 1*e* and suspended on the wall by a generally vertical crank 40, which is solid at its top end with one end of the shaft 35*a* which passes through the wall 1*e*, while at its bottom end it bears a centering peg 40*a*, the complete crank and peg being placed within an opening 41 formed in the face of the block 39 juxtaposed to this wall, the opening 41 having a deeper part receiving the peg 40*a*. The side of the block 39 facing the lever 36 and its roller 37 has a concave profile 39*a* of cylindrical sector shape centered on the axis X—X about which the arm 36 pivots, the radius of the profile 39*a* being such that, in the rest position shown in FIG. 6, in which the crank 40 is substantially vertical, a gap is left between the roller and the profile 39*a* which is slightly greater than the diameter d of the tube 31.

The tube 31 which leads to the nozzle 30 over the top of wall extends generally vertically downwards and its free end dips into a phial 42 containing a stock of animal semen 42*a*, which is maintained by clamps 42*b* at the bottom of the compartment 2. The compartment is also, as shown in FIG. 1, filled with insulating material 2*a* enabling the semen to be kept at a relatively low temperature. An intermediate portion of the tube 31 mates with the profile 39*a* of the block and enters and leaves the profile through two vertical guide channels 39*b*.

The block 39 is also supported by, and slides on, two horizontal guide rods 43*a* and 43*b* (see FIG. 6) which pass through holes drilled in the block, the guide rods being fixed to a support bar 44 disposed on the opposite side of the block 39 to the roller 37, compression springs 44*a* being interposed between the block 39 and the bar 44. The upper rod 43*a* slides in a blind hole in the block, while the lower rod 43*b*, adjacent the phial 42, is longer and projects into the channel 39*b* in the block when the block is in the rest position of the apparator as shown in FIG. 6, so as to pinch the tube 31 and prevent liquid above this level flowing away.

FIGS. 6 and 7 also show that, when the plate 24 and the lever 36 that it carries rotate through an angle of about 60°, the roller 37 can move downwards to the position shown in chain dotted lines in FIG. 6 without pinching the tube 31. On the other hand, when the cam 33 has lifted the roller 34 in the main compartment, following a rotation though 60° of the plate 20, the shaft 35*a* is rotated so that the peg 40*a* shifts the block forward towards the roller 37, and the rod 43*b* goes out of the guide channel 39*b*, to free the tube 31 at this level, while the roller 37, in its bottom position as shown in FIG. 7, now pinches the tube 31 against the profile 39*a*.

Lastly, as shown in FIG. 8, the arm 19*a* carried by the transverse bar 19 is extended by an opposed arm 19*b* bearing a vertical lever 45, whose upper end, at about the same height as the top 7*a* of the drum bears another bar 46 parallel to the axis X—X, on which is fixed a support sheet 46*a* extending towards the drum 4 and supported on it above the top slot 7*a*. Facing the lower part of the drum 4, a horizontal outlet slot 47 is formed in the front wall 1*a*, and a sheet 47*a* bearing on the bottom edge of the slot extends towards the drum 4 and approaches the circumference of the drum over its whole width.

The operation of the apparator described is as follows:

The operator transports the apparatus by hand, using handles which are not shown. When the apparatus is installed, the operator places in the hopper several packs of straws 11, and also places a phial 42 of semen under the insulating material 2*a*. As indicated above, in the rest position of the apparatus the lever 16 is in the upper position shown in FIGS. 1 and 2.

When the operator wishes to fill a straw, he performs the following two successive operations.

Firstly, he actuates the operating lever to bring it to the lower position shown in chain-dotted lines in the drawings with a circular stroke of 60°. During this stroke, the first of the straws in the row on the inclined plane 8 which extends from the hopper (this row having been formed previously by successive actuations of the lever so as to turn the drum 4 and with it the cylinder 10 which lets the straw through one at a time to form the row) enters the adjacent slot 7*b* and is then brought by the stroke of the lever to the top position 7*a* on the drum. In fact, in the direction of rotation of the lever referred to, the drive shaft 14 which carries the drum drives it through the free wheel 15 which connects them in this direction. During this stroke, the plate 20 which is solid with the drum 4 has also rotated through 60° and pulled the cable 25 which in turn displaces the piston 26 and compresses the spring 28. At the end of this rotation, the spring lug 32*a* which was 60° back on the plate 20 arrives at the top of the plate and engages the recess 32 of the slider 29 supporting the nozzle 30. During the same rotation of the plate 20, the peg 20*c* which it bears on its side engaged the control rod 19*a* which turned the transverse bar 19 and pivoted the lever arm 18 above finger 18*a* then disengaged from the notch in the wheel 17. This disengagement frees the wheel 17, and thus the drum 4, enabling then to rotate through 60°, since as well as the finger of the forward lever 18, the finger of the rear lever can also disengage due to the bezel on its end on which the facing edge of the notch 17*a* bears to push it back, the disengagement of the two levers 18 acting against the return spring 21. Still during the same rotation of the plate 20, it picks up the plate 24 when the pin 38 comes to the stop at the end of the opening 38*b*, and turns the lever 36 with its roller 37 downwards through 60° to bring it to the position shown in chain dotted lines in FIG. 6, without the roller pinching the tube 31 (as indicated above).

All the difference parts of the apparatus having moved as described, the operator can then fill automatically the straw disposed in the slot 7*a*, as follows:

The operator places the pipe 23 on the recess 22 excactly opposite the end of the straw 11, and advances it until the end of the pipe engages and fits over this straw, after which the force applied by the operator slides the straw in the slot 7*a* towards the nozzle 30 until that end of the straw engages sealingly with this nozzle (which has a suitably shaped orifice to receive the straw). The continuation of the thrust of the pipe 23 pushes the straw 11 and the nozzle 30, together with the slider 29 carrying the nozzle, against the bias of the springs 29*b*. When the slider moves back, the spring lug 32*a* is no longer retained by the notch 32 in the slider, so that the plate 20 is now freed to return with a 60° rotation in the opposite direction to the first rotation, under the action of the spring 28, which relaxes until all the parts return to the initial position. During this return motion, however, the plate 20 has only picked up the drive shaft 14 and lever 16, while the drum 4 remains stationary due to the operation of the free-wheel 15. It should also be noted that, during the first stroke, the two fingers 18*a*, operating like ratchets, have re-engaged in the following notch 17*a* of the wheel 17, so that their precise sizing, fitting the notch 17*a*, indexes precisely the position of the straw facing the nozzle 30, to prevent any possible jamming during the thrust movement described above. During the return of the plate 20, after taking up the lost motion, which the angular gap defined by the previously chosen positions of the pins 38 ensures, the plate 24 picks the arm 36 up in the return movement. It should be noted that, in the meantime, right from the start of the return of the plate 20, the cam 33 again acted through the roller 34 to pivot the shaft 35*a* and bring the counter block 39 into contact with the roller 37. During the same movement, as the block advances, the guide rod 43b no longer projects into the channel 39b and this section of the tube is liberated. The advanced position of the block 39 is held during the angular displacement corresponding to the angle of the cylindrical part 33a of the cam, so that during this return movement, the roller 37 which pinches the tube 31 against the block 39 pushes upwards in the tube a column of liquid which would be introduced into it by previous similar operations. This displacement of the column of semen, during the angular travel of the lever 36 displaces a corresponding quantity of semen through the nozzle 30 to fill the straw 11.

Once this dose is introduced into the straw, without any contact of the semen with a mechanical drive, the operator can extract the straw by pulling the pipe out in the direction Y, liberating the straw as it leaves the slot 7a, and also allowing the nozzle 30 and its slider 29 to return to the initial position in the path of the lug 32a.

The operator can then immediately perform the desired insemination using the pipe bearing the straw by pressing on the bulb 23a. The machine is then in the initial position described and shown in the drawings, and is ready to perform a further filling cycle. It should be noted that the second arm of the double lever 35 actuates a filled dose counter 48 fixed on the front wall 1a.

Figure 9:
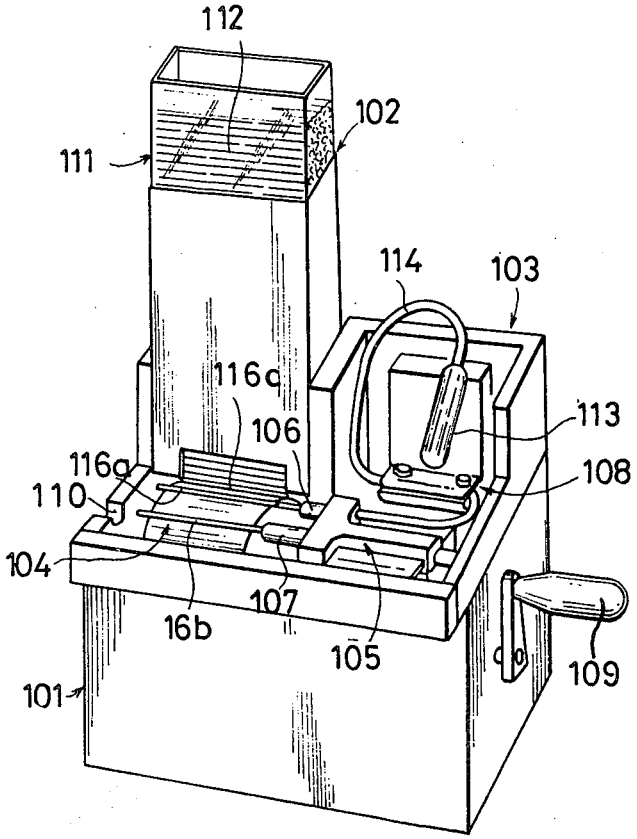
FIG. 9 is a perspective view of an apparatus which is a second embodiment of the invention.

The apparatus shown in FIGS. 9 to 14 comprises, as shown in FIG. 9, a main parallelepiped housing 101 whose top is shown open, but may be covered by lids for hygienic reasons, the main housing being completed at its rear and above its top by two other storage casings 102 and 103, containing respectively the straws and the semen.

Within the housing 101 are disposed, at the front a drum 104, and a slider 105 on which are fixed a nozzle 106 and a plunger 107, and at the rear, between the slider 105 and the casing 103, a pump block 108 for stepwise displacement of the semen. On the right side of the main housing 101, a crank handle 109 projects and controls an actuating shaft described below, while at the left of the main housing a recess 110 is formed for receiving a gun for gripping and using the straws.

In the upper block 102 a recharge or package 111 is disposed, containing a large stock of straws 112 all arranged parallel to the axis of the drum 4. In the other upper block 103, a phial or other supply of semen 113 is placed and kept under insulation, and a flexible tube 114 dips into the semen, leads out of this block through the pump block 108 and is fixed at its other end to the rear of the nozzle 106 facing the drum 104.

Figure 10:
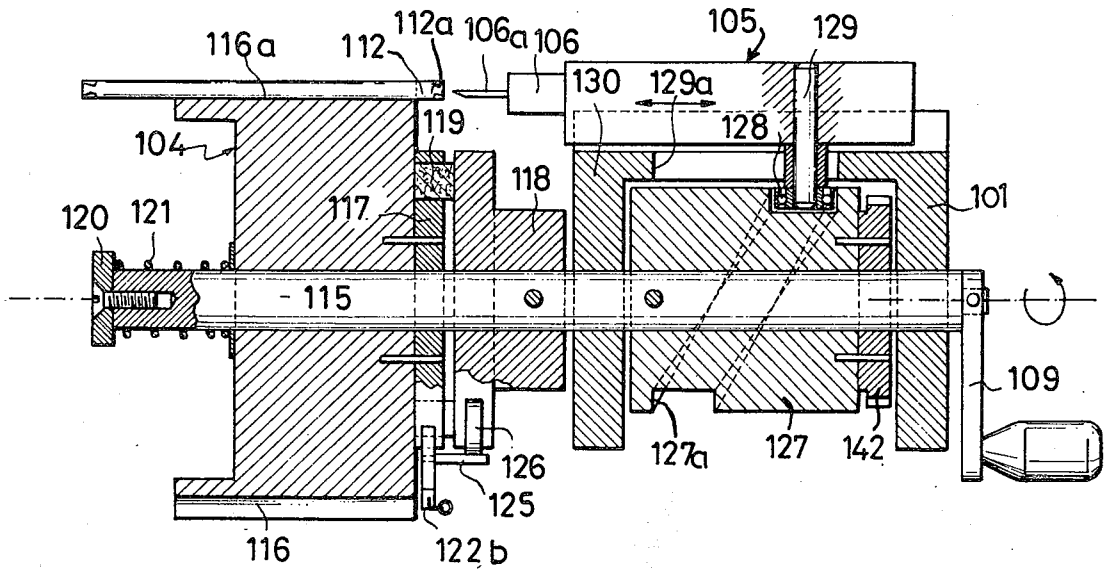
FIG. 10 is a vertical sectional view of the apparatus of FIG. 9 on the plane along the straw transport drum rotation axis.
Figure 11:
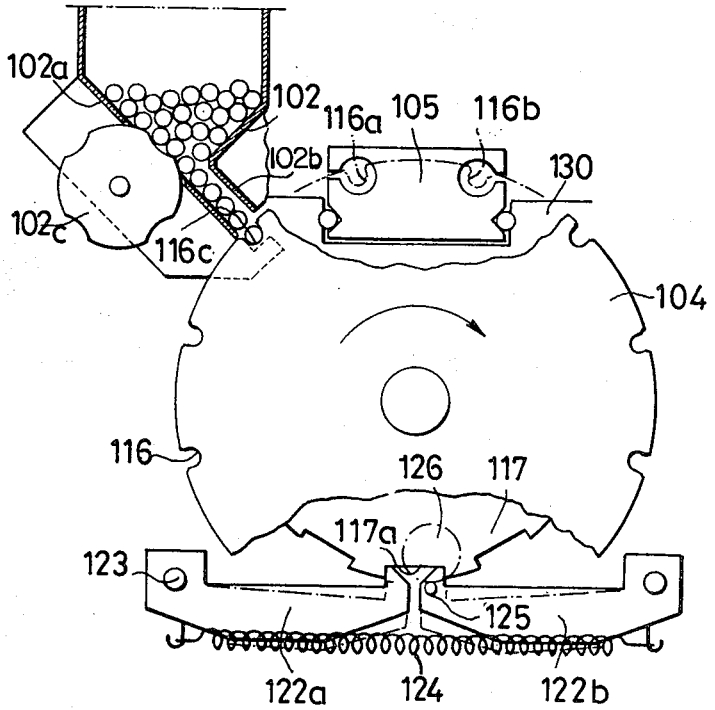
FIG. 11 is a part sectional view from the left of the members shown in FIG. 10.
Figure 12:
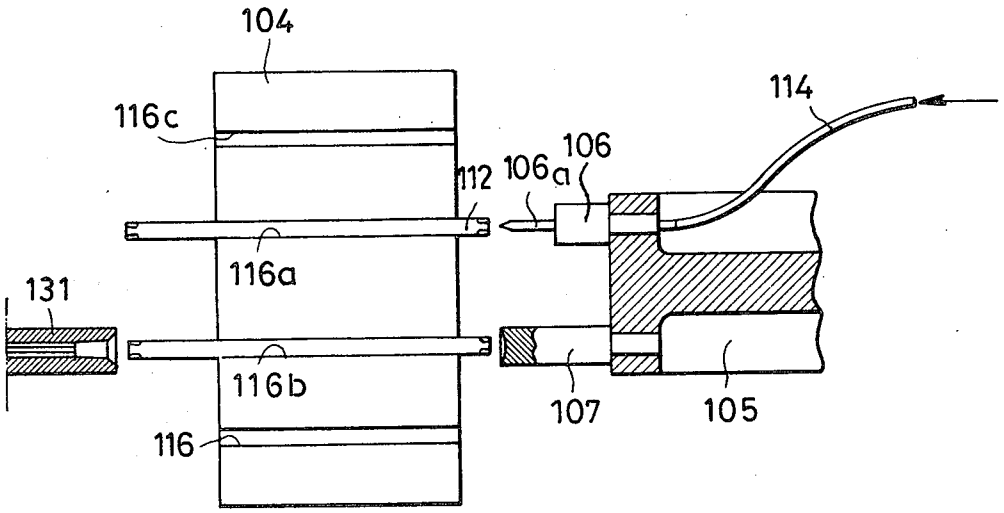
FIG. 12 is a part sectional plan view of the same members as FIG. 11

As shown in FIGS. 10, 11 and 12, the drum 104 is a cylindrical member which is mounted for free rotation on a horizontal shoft 115 which is journalled on the main housing 101 and extends across the whole width of the housing to project through its right wall and receive the actuating crank handle 109. On its circumference, the drum 4 has twelve slots 116 spaced regularly round its periphery extending parallel to its axis and having a semi-circular sections. Three of the slots are in particular positions, that is to say, two slots 116a and 116b disposed on each side of the top generatrix of the drum, and a third slot 116c disposed immediately before them in the direction of rotation of the drum, as shown in FIGS. 9, 11 and 12. At the side by the crank handle 109, a notched disc 117 is fixed to the drum 104 and is also free to rotate on the shaft 15 and, just beside the notched disc 117, a drive disc 118 is keyed to the shaft 115 with a slight gap from the disc 117. On the disc 117, several pads of friction material 119 project towards the disc 118 and engage the facing surface of the disc 118. At the side opposite to the crank handle, the shaft 115 bears at its free end a stop 120 which acts as abutment for a spring 121 surrounding the shaft 115 and bearing at its other end on the back of the drum 104 so as to bias the drum 104 and the disc 117 bearing the pads 119 into engagement with the disc 118.

As shown in FIGS. 10 and 11, the disc 117 has twelve notches on its edge, which are spaced angularly relative to the slots on the drum, so that one of the notches is at the bottom generatrix of the drum. Into this bottom notch engage the noses of two ratchets 122a and 122b which extend horizontally and transversely relative to the disc and which pivot on axes 123. Beneath the pivots 123, the ends of a tension spring 124 are fixed and bias the ratchet noses to engage in the notch. The two noses are bevelled on their facing edges, and the rachet 122b which is earlier in the rotation, has a transverse finger 25 on which a roller 126 carried by the edge of the disc 118 bears when the roller is at the bottom position. Thus, when the roller is at the bottom, its engagement with the finger 125 lifts the ratchet 112b and disengages the nose from the notch 117a, so as to allow free rotation of the notched disc 117 (the other ratchet disengaging due to its bevel) until the disc has rotated one twelfth of a revolution, when both ratchets reengage in the next slot 117a.

It is clear, then, that a full turn of the crank handle 109, of the shaft 115 and of the drive disc 118 corresponds to one twelfth of a complete turn of the notched disc 117 and drum 104 which is solid with it. During this twelfth of a turn, the pressure of the drum 104 and of the disc 117 through the pads 119 on the disc 118 under the bias of the spring 121 ensures drive of the drum 104 by the disc 118. However, when the ratchets 122a and 122b immobilise the notched disc 117, the pads 119 of this disc slip on the rotation disc 118 and the drum 104 is no longer driven.

As shown in FIG. 11, the upper block 102 terminates at the bottom in a hopper 102a, whose outlet is extended by an inclined ramp 102b which extends to reach the position of the slot 116c of the drum and into which successive bosses of a dispensing wheel 102c project to engage the straws one at a time in the ramp 102b.

As shown in FIG. 10, the actuating shaft 115 bears, between the drive disc 118 and its projection outside the housing 101, a cylinder 127 which is fitted on to the shaft and in whose circumference is formed a continuous closed groove 127a disposed in an oblique plane at approximately 45°. In this groove 127a, which acts as a cam, a roller 128 can run, the roller being disposed at the end of a rod 129 extending radially to the shaft 115 and solid with the slider 5, passing through an opening 129a which extends parallel to the shaft 115 in a horizontal sliding surface solid with the housing 101.

As shown in FIGS. 11 and 12, the slide 105 is guided for translation in a slide way formed in the surface 130 parallel to the axis of the shaft 115 and the slide projects above this surface so as to receive at its end facing the drum 104 the nozzle 106 and also the plunger 107. The nozzle and plunger are supported on the slider in the same horizontal plane and with a spacing corresponding to the spacing of the slots 116a and 116b of the drum 104. The slider is centered over the shaft 115, so that the nozzle 106 is positioned precisely facing the slot 116a and the plunger 107 facing the slot 116b.

The travel of the slider 105, that is to say of the roller 128, corresponds to the amplitude of the axial throw of the groove 127*a* along the shaft 115 and this amplitude, as also the precise position of the cylinder on the shaft, are arranged so that, when the roller is in its withdrawn position adjacent the crank handle 109, the end of the nozzle 106 which consists of a hollow needle 106*a* is disposed at a short distance from the facing end of a straw positioned in the slot 116*a*, while in the forward position of the roller, adjacent the drum 104, the hollow needle 106*a* engages over almost its whole length into the facing end of the straw. This needle is in fact dimensioned so that its outer diameter can engage with a slight grip within the trumpet-shaped doubled back edge 112*a* which the end of the straw 112 presents. In the same withdrawn position of the slider, the plunger 107, which has a cupped end, is also disposed at a short distance from the straw in the next slot 116*b*, while in the forward movement of the roller, the plunger displaces this straw so that it enters within the orifice 110 of the housing 101 in which the operator can engage the tip of a gun 131 to grip the straw. The tip of the gun presents an orifice which is slightly funnel shaped and within which the straw 112 can be push-fitted by the plunger 107. The gun 131 is provided with means for ejecting the contents of the straw 112 and also for ejecting subsequently the used straw.

Figure 13:
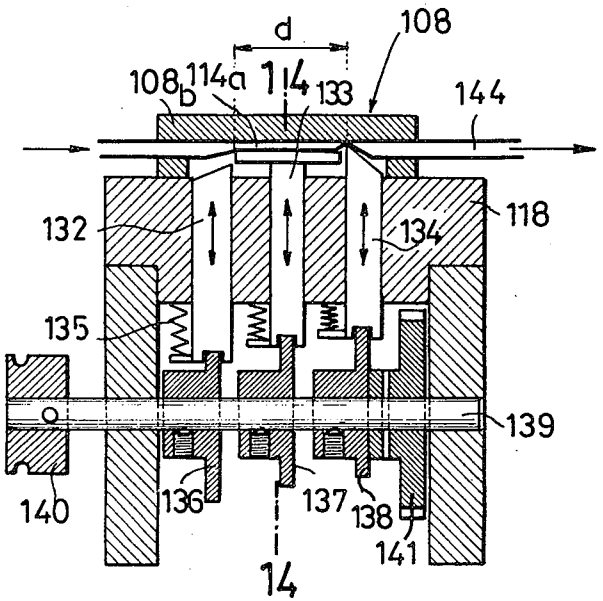
FIG. 13 is another view along a vertical section of the apparatus of FIG. 9 taken at the rear of the first section at the position of the means for displacing the semen.
Figure 14:
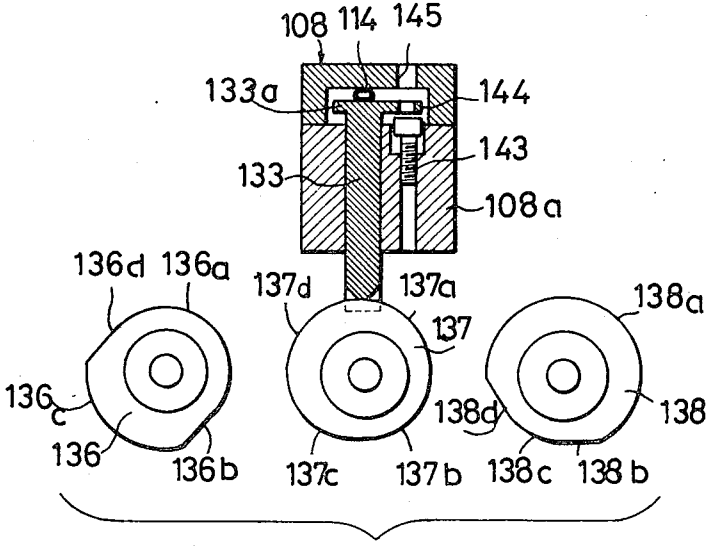
FIG. 14 is a sectional view along the line 14—14 of the members shown in FIG. 13.

As shown in FIGS. 13 and 14, the pump block 108 disposed at the rear of the slider 105 comprises a fixed body 108*a* solid with the housing 101 and having a horizontal top surface, and a plate 108*b* disposed above the body 108*a* with a certain gap. Between the body 108*a* and the plate 108*b*, the feed tube 114 is disposed for part of its length, between the semen stock 113 and the nozzle 106. Along the part of the tube 114 and beneath it are disposed three movable members 132, 133 and 134, which have the shape of vertical rods or fingers which are mounted to slide in the body 108 and are biased upwards by return springs 135. The two end fingers 132 and 134 have bevelled top ends, so as to be able to squash the tube 114 over its whole width when they are maintained in their uppermost position by means described below. The ends of these two fingers are spaced apart by a distance "d" along the tube and the central rod bears at its top end a horizontal plate 133*a* which can bear on the tube over its whole width and extends over almost the whole length "d".

The bottom ends of the three fingers 132, 133 and 134 are disposed in the same vertical plane, and straddle the respective edges of three can shaped discs 136, 137, and 138 which are keyed to a shaft 139 journalled in the housing 101. On opposite sides of the set of discs, the shaft 139 also bears a pulley 140 connected to the straw drive wheel 102*c* and a gear 141 which is driven by a gear 142 surrounding the shaft 115 and fixed to one end of the cylinder 127.

The three can discs are shown in FIG. 14 separated laterally, to clarify their profiles, in the positions corresponding to the start of the crank handle 109 for an actuating cycle (that is to say the position in which the roller 128 and hence the slider 105 are in the fully withdrawn position). The three cams comprise circular sections of maximum radius "R" corresponding to positions in which the associated fingers pinch the tube 114 off completely, circular sections of minimum radius in which the fingers are withdrawn from the tube 114, and of course sections connecting the circular sections. Starting from the top of the cam at the point engaged by the corresponding finger, the cam 136 presents a minimum radius section 136*a* over approximatory 130°, a connecting ramp 136*b* over approximately 30°, a maximum radius section 136° C. over approximately 110°, a further connecting ramp 136*d* over approximately 35° and then the minimum radius section 136*a* again. Similarly, starting from the point O, the cam 137 presents a continuous ramp surface 137*a* over approximately 125°, then a minimum radius surface 137*b* over approximately 55°, a further ramp surface 137*c* over 90°, a maximum radius surface 137*d* over 35° and again the ramp surface 137*a*. Lastly, starting from the point O, the cam 138 comprises a maximum radius surface 138*a* over approximately 140°, a ramp surface 138*b* over 40°, a minimum radius surface 138*c* over 55°, a second ramp surface 138*d* over 35° and then again the maximum radius surface 138*a*.

Due to this arrangement, in the start position, the downstream finger 134 is fully raised and the upstream finger 132 fully lowered, while the plate 133*a* is in an intermediate position. During more than a quarter of a turn, the upstream and downstream fingers do not move, while the plate 133*a* continues to descend, thus increasing the volume of the chamber 114*a* defined in the tube 114 over the distance d. Once the plate 133*a* is fully covered, the upstream finger 132 begins to rise so as to cut off the inlet to the chamber 114*a* and soon after, the finger 134 descends so as to open the outlet. It is then approximately after half a turn of the crank handle, that the finger 133 rises to apply the plate 133*a* progressively to the tube 114 and squeeze out of the chamber 114*a* towards the nozzle 106*a* volume of semen corresponding precisely ot the capacity of the chamber.

Given that, in the mean time, the first half turn of the handle has very rapidly inserted the end of the needle 106*a* into the straw 112 until it is fully engaged therein, a quantity of semen contained in the tube 114 and corresponding to the volume of the chamber 114*a* is ejected from the end of the needle 106*a* and deposited within the straw 112. Shortly before plate 133*a* reaches its topmost position, the downstream finger 134 starts to rise progressively to shut off completely the outlet of the chamber 144*a* at the very moment when the plate 133*a* has squeezed out all the contents of the chamber 114*a*, and then the finger 132 descends again to open progressively the interior of the chamber 114*a* and enable the arrival of a further quantity of semen from the stock 113 under the pressure of gravity. During the second half turn of the crank handle, the slider 5 withdraws progressively and pulls the needle out of the straw 112, so that the needle deposits the semen in the straw during its backward motion, the needle only leaving the end of the straw once the plate 133*a* has been fully raised of course, that is to say after the whole dose of semen has been deposited.

Following from the above description and the partial operational features described, the operator proceeds generally as follows:

He places the dosage gun 131 in the orifice 110 of the apparatus and then progressively actuates the crank handle 109 with a continous and regular movement over a full turn. During the first twelfth of a turn, the shaft 115 and the disc 118 drive the drum 104 by friction because the ratchet 122*b* is withdrawn, so that a straw which had previously been deposited in the slot 116*c* from the hopper 102*a* is brought to the position of slot 116*a* opposite the nozzle 106, while the straw which has previously been filled in the position 116*a* is brought to position 116b opposite the plunger 107. During this first twelfth of a turn, the slider 5 has advanced slightly but not enough for the needle 106a to penetrate into the straw 112, while otherwise the cams 136, 137 and 138 have practically not changed the positions of the fingers they carry. In the next part of the movement, the slider 105 advances so that the needle 106a penetrates into the straw 112 and the fingers 132, 133 and 134 operates as described above to isolate and squeeze out a desired dose of semen towards the needle 106a and consequently a corresponding dose into the straw 112. As mentioned above, the end of the movement produces withdrawal of the slider 105 and the needle 106a leaves the straw 112, while the fingers 132, 133 and 134 operate to define a fresh volume of semen in the chamber 114a.

During the same movement, after the first twelfth of a turn, the plunger 107 displaces the previously filled straw in the slot 116b and engages it with force into the tip of the gun 131 and when, during the second half of the movement, the plunger 107 has been withdrawn by the slider 105, the operator can take the gun 131 out of the apparatus and perform the insemination proper on an animal.

Advantageously, within the body 108a, a vertical aperture is provided in which a regulator screw 143 is disposed with its top having a head projecting above the surface of the body 108a beneath a side portion 144 of the plate 133a. The upper plate 108b and the side portion 144 are apertured at 145 so as to provide access for a screwdriver to adjust the position of the regulator screw 143. It is clear that, according to the position of the screw, the bottom of the travel of the plate 133a is controlled, and consequently the volume of the chamber 114a defining the dose of of semen to be injected into the straw.

We claim:

1. A portable, mechanical apparatus for use by an operator the filling of a straw with semen, comprising:

(a) a housing;

(b) rotating means rotatably mounted in said housing, said rotating means being rotatable about an axis and forming a peripheral slot substantially parallel to said axis suitable for releasably holding the straw, said slot having a dispensing position and a filling position, and said dispensing and filling positions being angularly displaced from each other;

(c) dispensing means for mechanically dispensing the straw into said slot when said slot is in said dispensing position, said dispensing means being proximate to said rotating means;

(d) lever means for manually mechanically rotating said rotating means to advance said slot from said dispensing position to said filling position;

(e) means for containing a supply of semen;

(f) a nozzle;

(g) engaging means for mechanically bringing said nozzle and the straw into fluid communication when said slot is in said filling position, said engaging means being operatively disposed relative to said rotating means;

(h) a pliable tube disposed to bring said containing means and said nozzle into fluid communication;

(i) peristaltic pump means operatively connected to said tube for peristaltically displacing a controlled quantity of semen in said tube so as to expel a corresponding quantity of semen from said nozzle into the straw once said nozzle and the straw are in fluid communication, said peristaltic pump means being operatively mechanically connected to said rotating means; and (j) straw holding means for holding the filled straw, said straw holding means being in operative and removable proximity of said rotating means, wherein said straw holding means comprises means for ejecting semen into the ovaduct of an animal, and wherein said straw holding means obviates the need for the operator to touch the filled straw with his fingers, whereby the operator supplies substantially all of the mechanical power necessary to operate said apparatus by operating said lever means, and said apparatus is thereby portable and readily cleanable.

2. The apparatus in accordance with claim 1, wherein said nozzle is operatively configured for movement longitudinally of said slot when said slot is in said filling position, and wherein said apparatus further comprises energy storage means for storing mechanical energy as said rotating means is rotated to advance said slot, said energy storage means being operatively connected to said rotating means, and drive means operatively connected to said energy storage means for driving said pump means in response to movement of said nozzle, said drive means utilizing the mechanical energy stored in said energy storage means.

3. The apparatus in accordance with claim 2, wherein said straw holding means is disposed to hold the straw and push the straw against said nozzle, wherein said nozzle moves in response thereto to cause said drive means to drive said pump means.

4. The apparatus in accordance with claim 2, wherein said engaging means comprises a slider, said slider being operatively configured for movement longitudinally of said slot when said slot is in said filling position, and said nozzle is operatively connected to said slider, wherein said slider moves in response to movement of said rotating means to insert said nozzle into the straw, and wherein movement of said slider causes said drive means to drive said pump means.

5. The apparatus in accordance with claim 4, wherein said slot further has an ejecting position adjacent to said filling position, and wherein said engaging means further comprises a plunger, said plunger moving in concert with said nozzle and said plunger being disposed to longitudinally align with said ejecting position, said plunger acting to push a filled straw from said slot into operative contact with said straw holding means.

6. The apparatus in accordance with claim 2, further comprising latch means for permitting the mechanical energy stored in said energy storage means to drive said pump means, wherein said energy storage means comprises a resilient member and said drive means interconnects said resilient member and said pump means, and said latch means is responsive to movement of said nozzle to release the mechanical energy stored in said energy storage means.

7. An apparatus in accordance with claim 4, wherein said energy storage means further comprises damping means for controlling the pumping rate of said pump means.

8. The apparatus in accordance with claim 1, wherein said rotating means is substantially cylindrical and wherein said rotating means forms a plurality of peripheral slots substantially parallel to said axis and configured to releasably hold a plurality of straws, said slots being spaced substantially equally around said rotating means, and said lever means comprising means for rotating said rotating means to bring each of said slot from its dispensing position to its filling position.

9. The apparatus in accordance with claim 6, wherein said lever means comprises indexing means for successively immobilizing said rotating means in positions in which one of said slots is in its dispensing position while another of said slots is in its filling position, and disabling means responsive to operations of said engaging means for disabling said indexing means.

10. The apparatus in accordance with claim 1, wherein said peristaltic pump means comprises a rolling means for rolling contact with said tube to expel the semen.

11. The apparatus in accordance with claim 1, wherein said peristaltic pump means comprises a plurality of fingers operatively arranged to move substantially perpendicular to the longitudinal axis of said tube and disposed to apply pressure to said tube to pressurize and expel the semen.

12. A method for filling a straw with semen, comprising the following steps:

(a) placing the straw in a straw dispenser;

(b) transferring the straw from said straw dispenser to a peripheral slot in a substantially cylindrical drum;

(c) mechanically rotating said drum about its longitudinal axis to advance said slot and the straw from a dispensing position proximate to said straw dispenser to a filling position angularly displaced therefrom;

(d) mechanically positioning a nozzle into fluid communication with the straw;

(e) mechanically peristaltically pumping semen through said nozzle into the straw; and (f) removing the filled straw using a straw holder suitable for ejecting the semen within the straw into the ovaduct of an animal, wherein the filling of the straw with semen and removal of the filled straw do not necessitate the touching of the straw by an operator.

* * * * *

UNITED STATES PATENT AND TRADEMARK OFFICE

CERTIFICATE OF CORRECTION

PATENT NO. : 4,478,261

DATED : October 23, 1984

INVENTOR(S) : Bertrand Cassou, Robert Cassou and Maurice Cassou

It is certified that error appears in the above-identified patent and that said Letters Patent are hereby corrected as shown below:

Column 1, line 16, for [does] read --dose--.

Column 5, line 5, for [for] read --forwardly--.

Column 5, line 55, for [entended] read --extended--.

Column 9, line 58, delete [a].

Column 10, line 24, for [112b] read --122b--.

Column 12, line 43, for [144a] read --114a--.

Signed and Sealed this

*Ninth* Day of *July 1985*

[SEAL]

*Attest:*

DONALD J. QUIGG

*Attesting Officer* *Acting Commissioner of Patents and Trademarks*